United States Patent [19]

O'Neal

[11] Patent Number: 4,735,059

[45] Date of Patent: Apr. 5, 1988

[54] HEAD PRESSURE CONTROL SYSTEM FOR REFRIGERATION UNIT

[76] Inventor: Andrew W. O'Neal, 18517 - 8th Ave. NE., Seattle, Wash. 98155

[21] Appl. No.: 20,376

[22] Filed: Mar. 2, 1987

[51] Int. Cl.[4] ..... F25B 41/00

[52] U.S. Cl. ..... 62/196.4; 62/509; 62/DIG. 17

[58] Field of Search ..... 62/509, 196.1, 196.4, 62/117, 183, DIG. 17

[56] References Cited

U.S. PATENT DOCUMENTS

| | | | |
|---|---|---|---|
| 3,248,895 | 5/1966 | Mauer | 62/196.4 |
| 3,478,533 | 11/1969 | Kocher et al. | 62/DIG. 17 |
| 3,844,131 | 10/1974 | Gianni et al. | 62/196.1 X |
| 3,905,202 | 9/1975 | Taft | 62/152 |
| 4,068,494 | 1/1978 | Kramer | 62/509 X |
| 4,136,528 | 1/1979 | Vogel et al. | 62/196.4 X |
| 4,457,138 | 7/1984 | Bowman | 62/196.1 |
| 4,566,288 | 1/1986 | O'Neal | 62/196.1 |

*Primary Examiner*—Harry B. Tanner

*Attorney, Agent, or Firm*—Garrison & Stratton

[57] ABSTRACT

An improved refrigeration system that has an air cooled condenser exposed to outdoor ambient conditions and which automatically maintains sufficient head pressure during cooler weather for adequate liquid flow to the expansion valve of the evaporator by backflooding the condenser. Sub-cooling of the liquid in the condenser results from the backflooding and this sub-cooled liquid is diverted through a bypass line around the receiver to a sub-receiver and thereby to the liquid line to the expansion valve. In warmer weather, the liquid or a liquid and gaseous mixture from the condenser can enter the receiver or the bypass line. The liquid line out of the receiver forms a drop leg and joins the bypass line at the sub-receiver at a sufficient elevation below the receiver so that the pressure due to the static head at the sub-receiver is greater than the pressure at the receiver, said pressure difference causing any gaseous and liquid mixture from the condenser to flow to the receiver. Therefore uncondensed (flash) gas does not enter the liquid line to the expansion valve.

21 Claims, 5 Drawing Sheets

HEAD PRESSURE CONTROL SYSTEM FOR REFRIGERATION UNIT

DESCRIPTION

1. Technical Field

This invention relates to the technical field of commercial and industrial type refrigeration and air conditioning systems. This invention further relates to a simplified head pressure control system which improves the cooling efficiency of the system.

2. Background of the Invention

In a conventional refrigeration system, the capacity of an air cooled condenser is proportional to the temperature difference between the condensing temperature of the refrigerant and the ambient air temperature entering the condenser. The condenser is usually designed to operate efficiently at a temperature difference which is suitable for summer conditions. In winter conditions, the capacity of the condenser increases substantially because of the reduction in the ambient air temperature which enters the condenser. When the capacity of the condenser increases, the system-head pressure and the liquid-line pressure decrease, the liquid refrigerant in the liquid supply line which feeds the expansion valve may flash to a gaseous state, and consequently the amount of liquid refrigerant which is available to the evaporator is reduced. Because of these problems, a head-pressure control mechanism is required in colder ambient conditions to elevate the head pressure, thereby, increasing the efficiency of the system.

Many methods of controlling the head-pressure have been used. One such method regulates the amount of the ambient air which passes through the condenser by either cycling the fans or by controlling the speed of the fan motors. Alternatively, dampers have been used to limit the airflow through the condenser. Backflooding of the liquid refrigerant into the condenser, which limits the condensing surface, also achieves head-pressure control. Many such control systems have been proposed or are in use, such as those systems described in: U.S. Pat. No. 2,934,911; 2,986,899; 2,954,681; 2,963,877, 3,905,202; 4,068,494; 4,373,348 and 4,457,138.

Backflooding of the condenser results in the sub-cooling of the liquid refrigerant which is in the condenser. By sub-cooling the liquid refrigerant, there is less need to use some of the latent heat of evaporation to cool the liquid refrigerant from the condensing temperature to the temperature at which evaporation takes place. This increases the efficiency of the system. The value of the sub-cooled liquid is usually lost, however, because the sub-cooled liquid is mixed with the discharge gas at the head-pressure control valve prior to entering the receiver or it is mixed with the discharge gas being diverted to the receiver. Although some systems bypass the sub-cooled liquid around the receiver, in warmer weather these systems retain the problem of controlling the amount of uncondensed gas which passes to the expansion valve from the condenser.

Expansion valves are designed to operate with only liquid entering at their inlet ports. The entrance of uncondensed gas into the expansion valve reduces the efficiency of the expansion valve so that an inadequate supply of liquid refrigerant is sent to the evaporator, and the efficiency of the system is lowered.

Dealing with this problem, Taft et al., U.S. Pat. No. 3,905,202, Willitts, U.S. Pat. No. 4,430,866, and Ares et al., U.S. Pat. No. 4,522,037 suggest that an evaporative sub-cooler should be used in the liquid supply line which leads to the expansion valve to condense any flash gas that may occur. In effect, the evaporative sub-cooler can act as an additional condenser. Such systems require greater work from the compressor. Vana, U.S. Pat. No. 4,328,682 teaches that a solenoid valve, which is controlled by a sensing device that detects flashing in the liquid line, should be used to divert discharge gas to the top of the receiver. By doing this, however, the head pressure can easily exceed the normal head pressure of the system which is an undesirable condition. Kramer, U.S. Pat. No. 4,068,494, teaches that the system should be charged with sufficient liquid refrigerant to fill the receiver and partially fill the condenser thereby maintaining a liquid seal in this portion of the system. If the system is so charged, there is very little space available for "pump down" and a high condensing pressure can result. Bowman, U.S. Pat. No. 4,457,138 discloses a inlet pressure regulating valve that discharges into the bottom of the receiver which in warm weather conditions causes heating of liquid in the receiver. A temperature controlled solenoid valve that bypasses the receiver is also shown that connects up stream from the inlet pressure regulating valve which can interfere with backflooding of the condenser. My prior patent, O'Neal, U.S. Pat. No. 4,566,288, teaches that a liquid level sensor should be placed in a chamber at the outlet of the condenser to detect the passage of uncondensed gas and activate a sold state circuit to close a solenoid valve in the bypass line and prevent the flow of uncondensed gas to the liquid line. This design has worked very well, however, in some cases the cost of purchasing and installing such solid state circuitry is economically prohibitive. A simpler method of controlling the head pressure and preventing the flashing of gas into the expansion valve was needed.

OBJECTIVES OF THE INVENTION

The principal object of the present invention is to provide an improved method and apparatus for controlling the head pressure of a refrigeration system.

Another object is to provide an improved method and apparatus to prevent the flashing of uncondensed gas into the expansion valve.

A further object is to reduce the cost and installation labor required to control the head pressure and to prevent the flashing of uncondensed gas into the expansion valve.

Another object is to provide an improved method and apparatus for increasing the efficiency of a refrigeration system by having a sub-cooled liquid refrigerant flowing from the condenser for use in the evaporative cooling function of the refrigeration system.

SUMMARY DESCRIPTION OF THE INVENTION

The present invention is a simpler and more passive method of controlling the desired flooding of the condenser without requiring the control system utilized in my earlier issued patent, U.S. Pat. No. 4,566,288. This invention is useful, as is my previous invention, as a retrofit for existing systems as well as in new installations, and can be incorporated into factory assembled condensing units. A requisite of one embodiment of this design is that the receiver is located at about the same elevation as the condenser. If this is a rooftop installation, there are several advantages in this placement. First there is greater static head pressure in the liquid line to the evaporators. At 90 degrees F. there is one pound per square inch more pressure for each 1.8 feet of vertical rise for Freon R-12. For R-502 the one psi increase occurs with each 1.84 feet vertical rise and for R-22 at each 1.98 feet vertical rise. Imposition of this amount of static head limits the formation of flash gas in the liquid line due to pressure drop caused by long lines, restrictions of fittings, and valves, and by liquid refrigerant lines passing through heated areas. Secondly, there is less heat gain than if the receiver is located in a machine room or other heated area and no space has to be allocated in the machine room for receivers. Sun shielding should be provided and all liquid lines in warm areas should be insulated. In cold climates, the receivers may require insulation and a thermostatic controlled heater. The temperature of the refrigerated space is a controlling factor to be considered as to whether a heated receiver is required.

The refrigeration system which accomplishes the foregoing objectives has an air cooled condenser exposed to outdoor ambient conditions and which automatically maintains sufficient head pressure during cooler weather for adequate liquid flow to the expansion device of the evaporator(s) by backflooding the condenser. Sub-cooling of the liquid in the condenser results from backflooding and this sub-cooled liquid is diverted through a bypass conduit around the receiver directly through the liquid conduit to the expansion valve(s). Utilizing the sub-cooled liquid without reheating increases the capacity of the evaporators and the system. In warmer weather the liquid or liquid and gaseous mixture from the condenser can enter the receiver or the bypass conduit. A liquid conduit drop leg out of the receiver is provided so that its junction with the bypass conduit at a sub-receiver located at a specific elevation below that of the receiver condenses any gas in the bypass conduit or the sub-receiver. The liquid line to the expansion valve exits from the bottom of the sub-receiver so that flash gas is eliminated. Thus the need for the control apparatus in prior art devices is effectively eliminated by judicious use of the pressures imposed upon the refrigerant liquid by the liquid head in the drop leg and sub-receiver.

BEST MODE OF CARRYING OUT THE INVENTION

Figure 1:
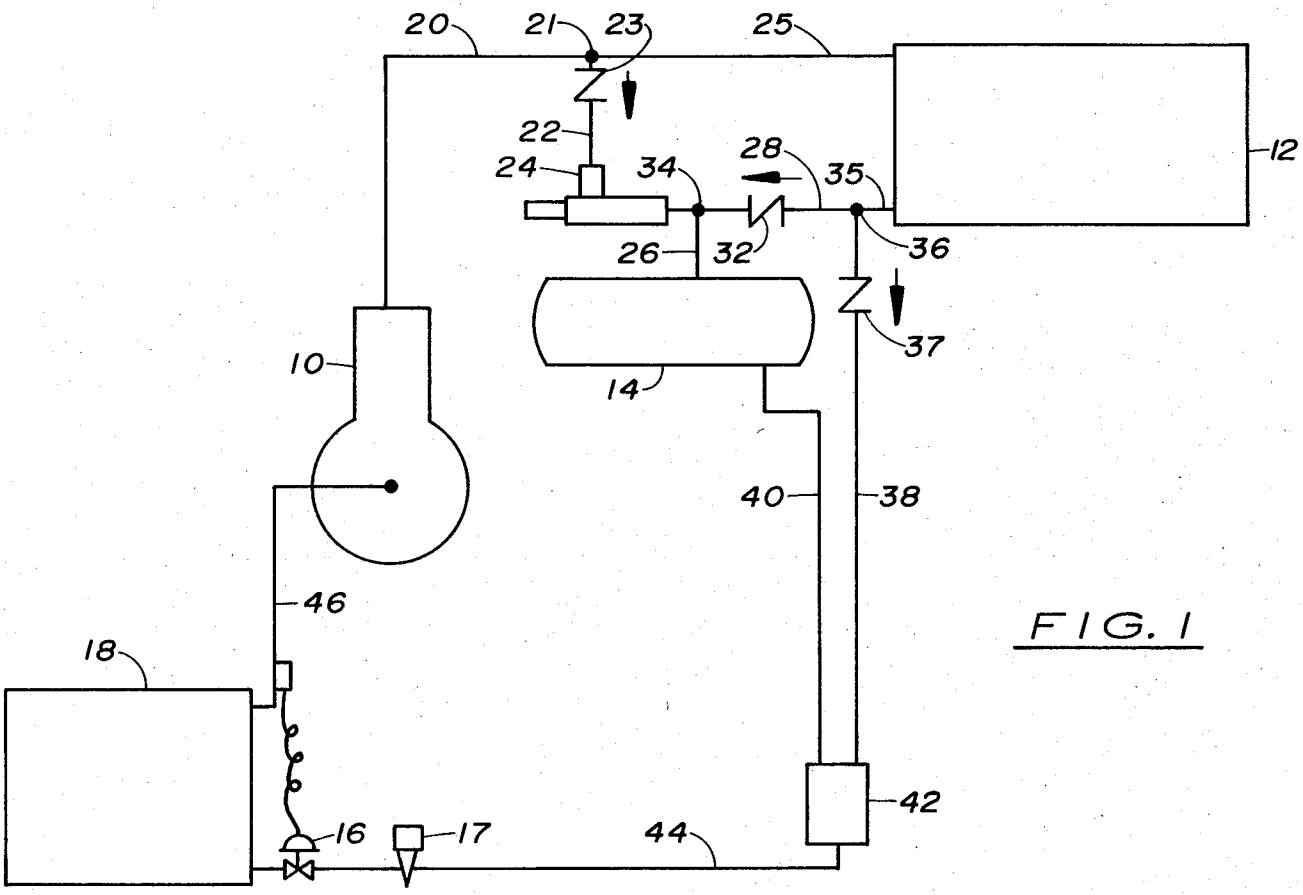
FIG. 1 is a diagram of a refrigerant system having the apparatus and method of this invention including a sub-receiver incorporated therein.

Referring to the drawings, wherein like numerals indicate like parts, there is seen in FIG. 1 a schematic diagram of a refrigerant system embodying this invention. A compression type refrigeration system is shown having an air cooled condenser 12 exposed to outside ambient conditions. Compressor 10, condenser 12, receiver 14, an expansion valve 16, and an evaporator 18 are shown connected in a closed refrigeration loop. High pressure gas from the compressor enters the top of the condenser 12 and is liquified in full or in part by heat transfer to the flow of ambient air through the condenser 12. The refrigerant exits the condenser 12 through line 35 to line 28 and through check valve 32 to the top of the receiver 14 under normal operating conditions. The receiver 14 ensures separation of gaseous and liquid refrigerant and stores liquid refrigerant. Line 22 tees off of discharge line 20 through check valve 23 to an adjustable outlet pressure regulating (OPR) valve 24 which closes upon rise of outlet pressure. In cooler weather, discharge gas from the OPR valve flows into line 26 to the top of the receiver 14. Line 28 from the condenser 12 joins line 26 at juncture 34. Check valve 32 in line 28 permits flow from the condenser 12 only so discharge gas goes to the top of the receiver 14 and not into the bottom of condenser 12. The OPR valve 24 is typically set for about 40 to 50 PSI above the evaporating pressure in evaporator 18 and for an evaporating pressure of 20 PSIG would be 60 PSIG for R-12. The OPR valve 24 would be closed in ambient conditions above about 50 degrees F. In cooler weather OPR valve 24 opens admitting discharge gases to receiver 14. Due to the pressure drop through the condenser 12, liquid is forced from the the receiver 14 through liquid drop leg 40 to a small sub-receiver 42 which supplies liquid to the expansion valve 16 through line 44. Liquid is prevented or limited from leaving condenser 12 by the back pressure in sub-receiver 42 due to the discharge gas pressurizing the receiver and backfloods the condenser 12 limiting the condensing surface until a point is reached where the condensing pressure reaches the setting of the OPR valve. The condenser and the receiver should be at about the same elevation so that there will be no static head in line 38 that would prevent the backflooding of the condenser. An equilibrium is established and the OPR opens only enough to maintain the set condensing pressure. If there is a demand for more refrigerant by the evaporator, the level in the condenser will fall and be corrected by the OPR valve opening more, increasing the pressure in receiver 14 and forcing liquid out of the receiver 14 until the pressure reaches the set point. Conversely, when there is a pumpdown of one evaporator, the OPR valve will close and excess refrigerant in the condenser will flow through check valve 32 into receiver 14.

The backflooded liquid in the condenser is sub-cooled and can approach within about 2 degrees F. of the air entering the condenser. This sub-cooled liquid flows from a juncture 36 with line 28 through bypass line 38 to the top of sub-receiver 42. Under stabilized conditions, most of the sub-cooled liquid from the condenser goes directly through the sub-receiver and then to the evaporator. This sub-cooling is important to increase the overall efficiency of the system.

Figure 2:
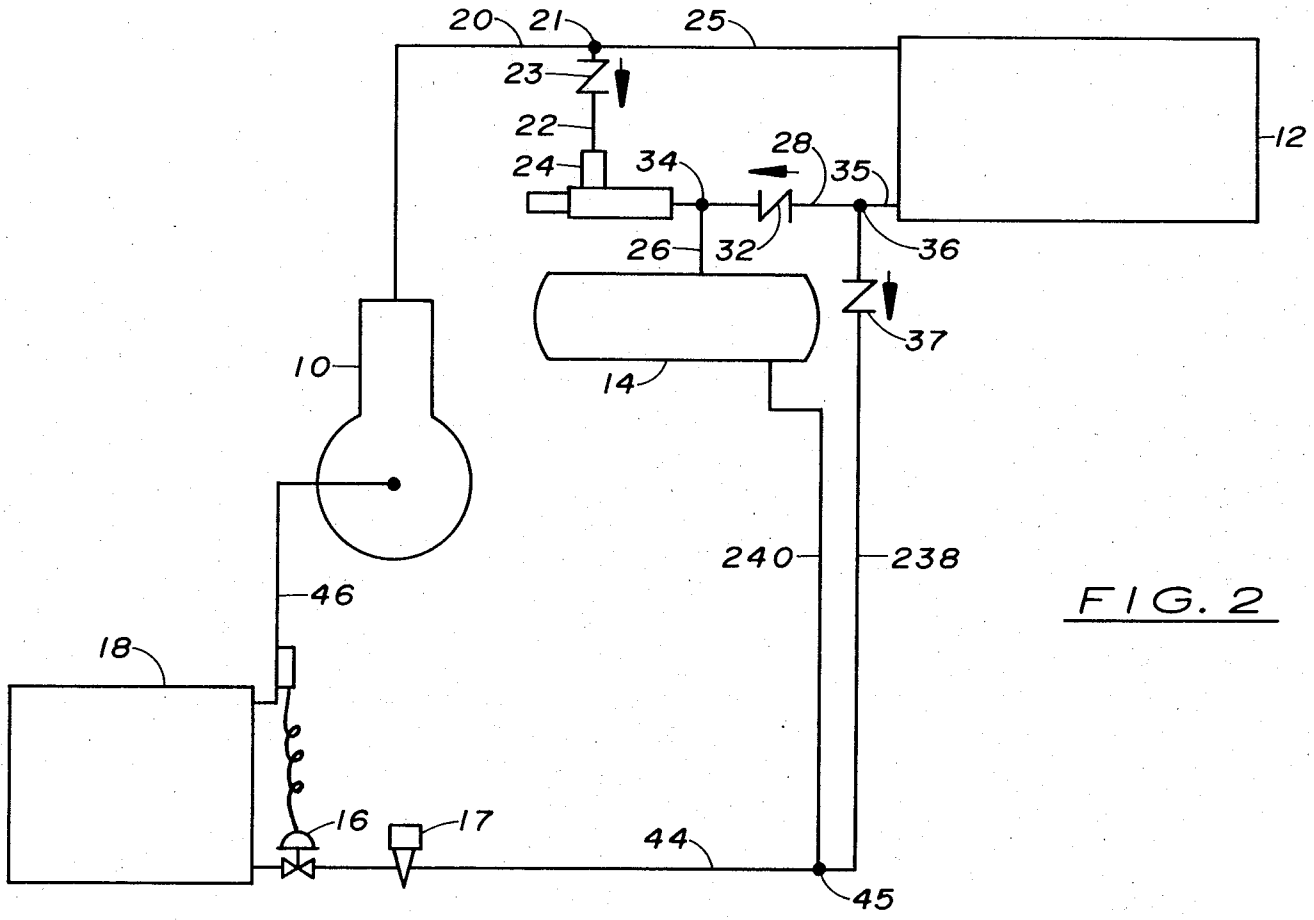
FIG. 2 is a second embodiment of this invention wherein no sub-receiver is used.
Figure 3:
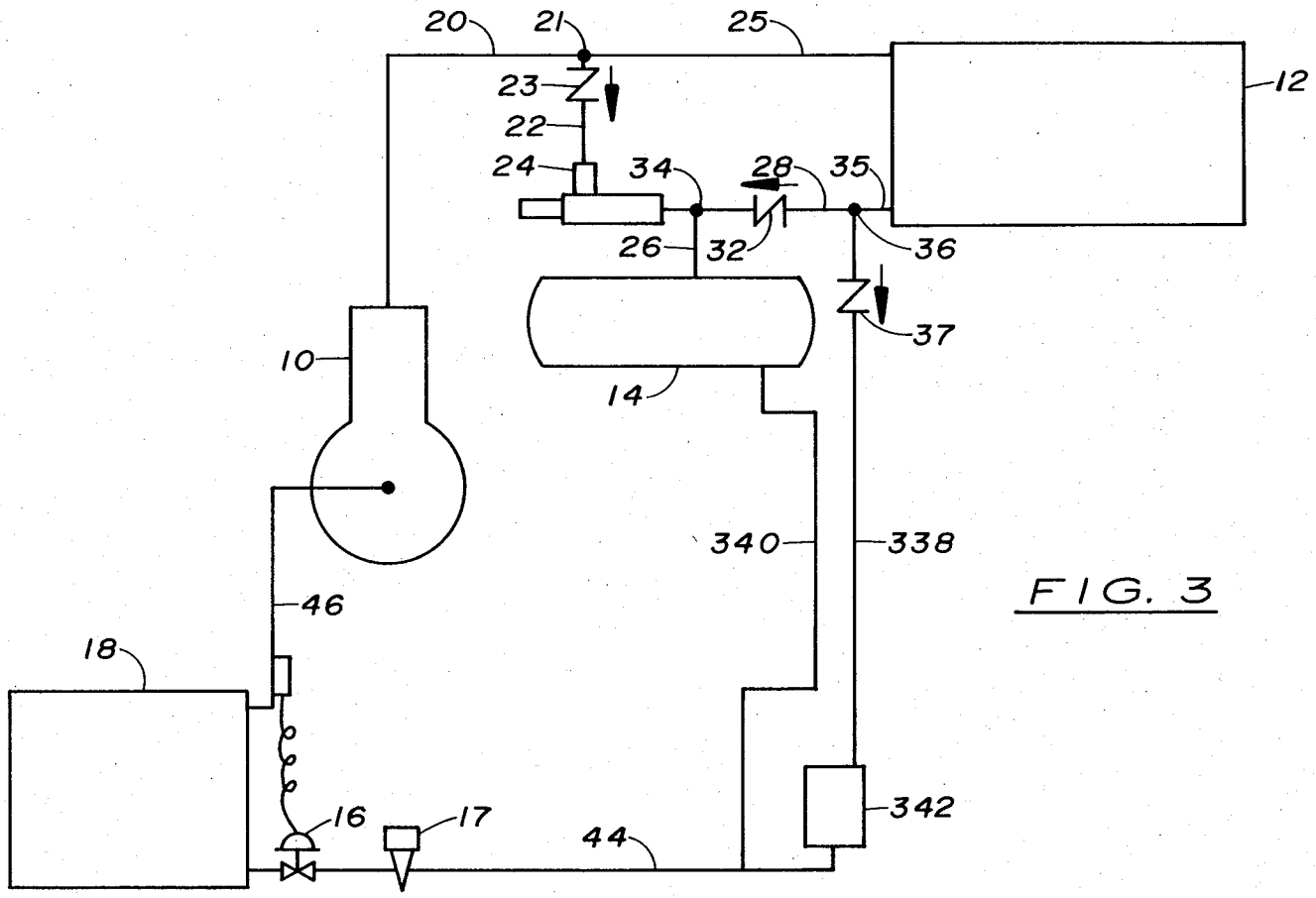
FIG. 3 is a third embodiment of this invention wherein the liquid line from the receiver joins the liquid line to the expansion valve at close proximity to the sub-receiver.

In warmer weather the OPR valve remains closed and liquid with uncondensed gas from condenser 12 can drain through check valve 32 into receiver 14 where there is a phase separation and liquid will enter drop leg 40 to sub-receiver 42 and then into liquid line 44 to the evaporator. Liquid and uncondensed gas can also enter bypass line 38 and the uncondensed gas condenses in line 38 the sub-receiver 42 because of the static head in the drop leg 40 out of the receiver which typically is about five feet in height. Under stabilized conditions the uncondensed gas in bypass line 38 condenses at about mid point in line 38 and almost all of the liquid and uncondensed gas will flow through check valve 32 into the receiver 14. In cool weather, subcooled liquid will fill the bypass completely and may be partially backflooded into the condenser so there is greater static head than in the liquid line from the receiver so subcooled liquid will flow through the sub-receiver to the liquid line to the expansion device. In some cases it may be possible to eliminate the sub-receiver 42 as shown in FIG. 2 if the drop leg 40 is of sufficient diameter and height and the bypass line 38 is adequately sized to obtain complete condensation and thereby prevent entry of flash gas into liquid line 44. The presence of sub-receiver 42 is good insurance that there will be no flash gas in the liquid line and also provides a reserve of liquid when a high velocity of the liquid flowing to the expansion valves is encountered. FIG. 3 shows an other alternate system using a two connection sub-receiver where drop leg 40 joins liquid line 44 at juncture 45 instead of entering sub-receiver 42. Because of the static head in drop leg 40, liquid will still fill the sub-receiver. A solenoid valve 17 may be provided in line 44 to stop the flow of liquid to expansion valve 16.

Another advantage of this system is that where a heat reclaim coil is used in series with the condenser and an inlet pressure regulating valve is used to control the amount of heat reclaimed in cooler weather, the OPR valve will maintain the set receiver and condenser outlet pressure and sub-cooled liquid will be delivered to the liquid line and then to the evaporators.

Referring specifically to FIG. 2, the second embodiment of the invention is shown in which no sub-receiver is present. The sub-cooled liquid from condenser 12 passes directly through check valve 37 into conduit 238 which connects to the liquid line 44. In conditions where the size of conduit 238 and the height of the liquid leg therein is sufficient to insure that all gas is condensed before it reaches line 44, the sub-receiver can be omitted as shown. In this embodiment the liquid drop leg 240 maintains sufficient head in conduit 238 to insure complete condensation of flash gas therein before entry of the liquid into liquid line 44.

The third embodiment shown in FIG. 3 of the drawings is a minor modification of the apparatus of FIG. 1 wherein the liquid drop let 340 enters liquid line 44 below the sub-receiver 342. In this embodiment the liquid drop leg 340 provides a sufficient head of liquid in sub-receiver 342 and conduit 338 so that uncondensed gas from condenser 12 will be condensed in conduit 338 or sub-receiver 342, thus preventing entry of any lash gas into liquid line 44. In all other respects the embodiment FIGS. 2 and 3 operate substantially identically to that described above with respect to FIG. 1.

Figure 4:
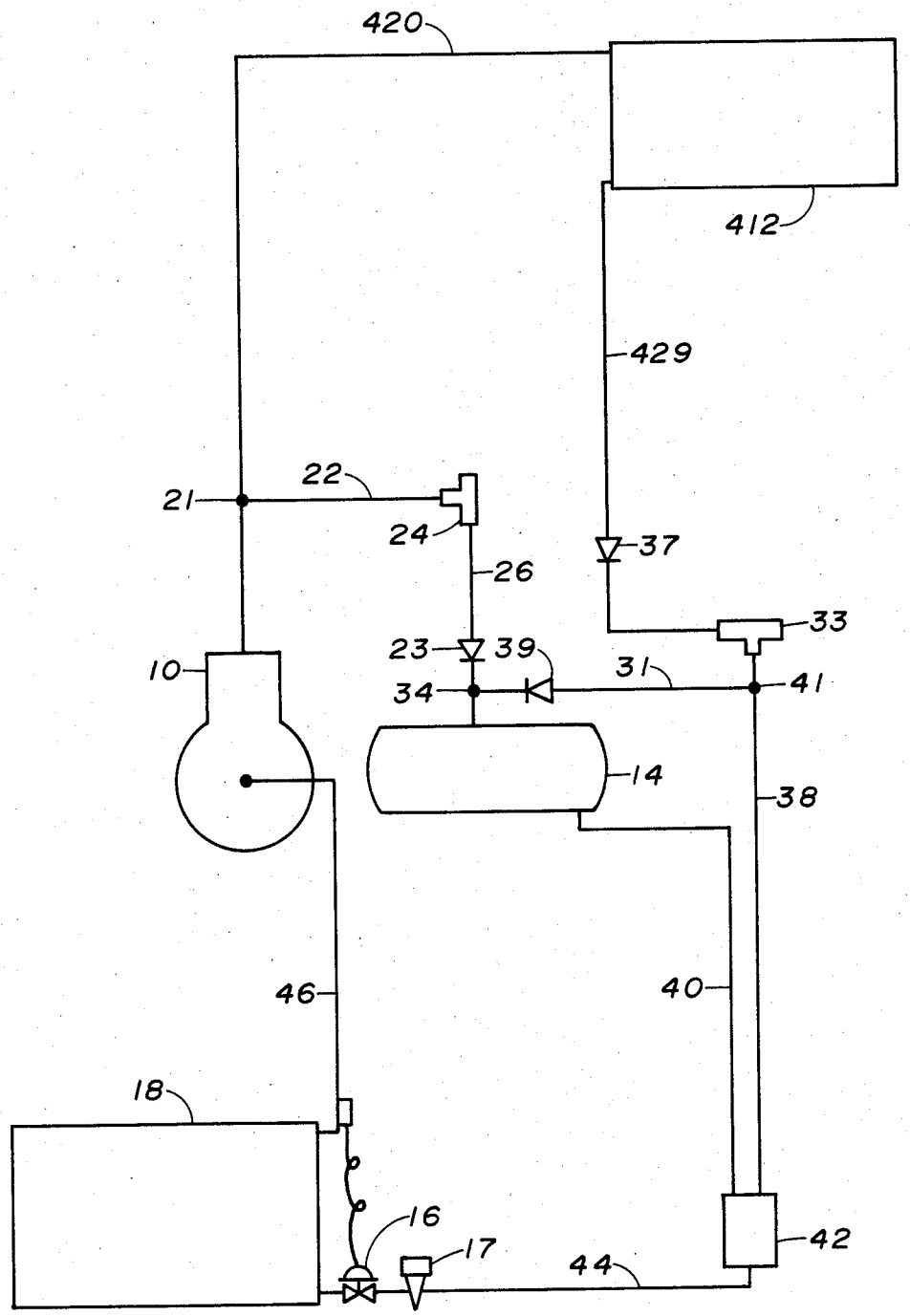
FIG. 4 is a fourth embodiment of this invention especially useful in roof top condenser installations.

In FIG. 4 a further embodiment of this invention is shown in which the condenser 412 is located at an elevated location above the other operational equipment of this system. For example, when the condenser is desirably located on the roof of the building housing the system and the extended conduits 420 and 429 are utilized. In cooler ambient temperatures, the pressure in the condenser is maintained by a inlet pressure regulating valve 33 (IPR) which closes on a drop of inlet pressure. The closing of this valve causes backflooding of liquid in the condenser 412 thereby limiting the condensing surface in the condenser until the set point of the IPR valve is reached. The pressure in the receiver is maintained by admitting discharge gas from the compressor 10 to the receiver 14 through line 22 and is controlled by outlet pressure regulating (OPR) valve 24 that is set at a pressure of 2 to 5 PSI less than the pressure setting of IPR valve 33. Check valve 37 prevents migration of refrigerant to the condenser when the compressor is not operating.

In warmer weather the IPR valve remains open and the OPR valve remains closed. The balance of the system is identical to that shown in FIG. 1 and the operation in warm and cool weather conditions is similar to that described with respect to FIG. 1.

Figure 5:
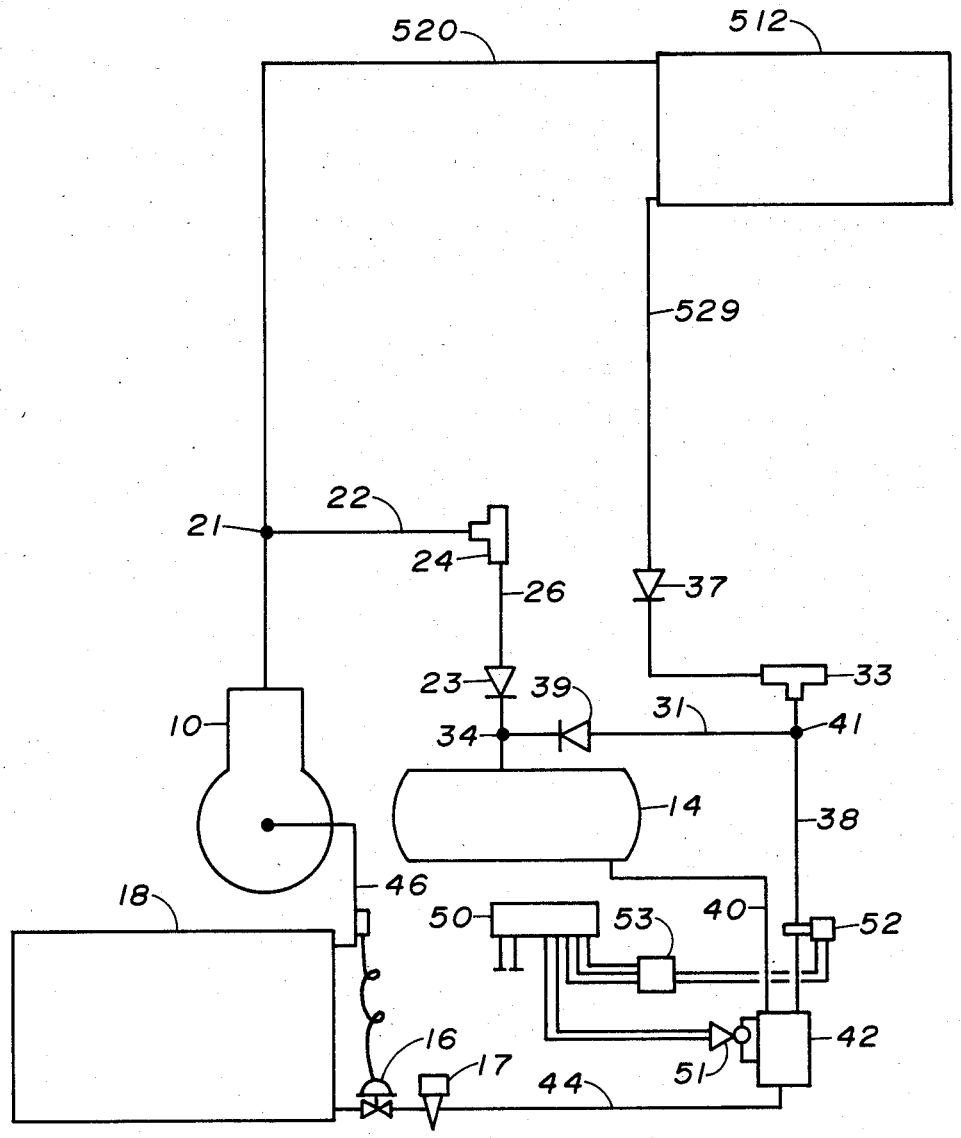
FIG. 5 is another embodiment of this invention where the sub-receiver is located at about the same elevation as the receiver in roof-top condenser installations.

In FIG. 5 a final embodiment of this invention is shown where the condenser 512 is located at a substantial elevated location above the other operational equipment of the system and in which space restrictions prevents placing the sub-receiver at a adequate elevation lower than the receiver. A liquid level sensing thermistor 51 is mounted in a fitting of a side arm connection of the sub-receiver 42 so that when uncondensed gas from the condenser 412 enters the sub-receiver through line 38, the subsequent lowering of the liquid level in the sub-receiver below the thermistor will cause the solid state control circuit 50 to de-energize solenoid valve 52 which shuts off the flow in line 38 to the sub-receiver and causes liquid and uncondensed gas from the condenser to flow through line 31 to the receiver 14. A "delay on make" time delay relay 53 prevents short cycling of solenoid valve 52.

For clarity, various components normally used in refrigeration systems are not shown on the drawings and this description does not intend that they not be used. Such items as driers, liquid indicators, valves for service and pumpdown procedures, solenoid valves, relief valves, check valves to prevent undesired migration of refrigerant in the system and other accessories well known to the refrigeration technician can of course be included. Other changes and modifications will be apparent to those of ordinary skill in the refrigeration arts and are included within the scope of this invention as defined in the claims set forth below.

I claim:

1. A refrigeration system having a closed refrigerant loop comprising:

an evaporator;

an air cooled condenser;

a compressor connected between said evaporator and said condenser;

an expansion device connected between said condenser and said evaporator;

a receiver for separating gaseous refrigerant and liquid refrigerant prior to said liquid refrigerant entering said expansion device;

a pressure regulating means connecting said compressor to said receiver for automatically maintaining the pressure in said receiver and said condenser in cool ambient conditions;

a means connecting the outlet of said condenser to said receiver, including a check valve permitting flow from the condenser into the top of said receiver;

a bypass means for diverting sub-cooled liquid refrigerant from said condenser to said expansion device, thereby bypassing said receiver during cooler ambient temperature conditions, said bypass means having a static pressure of said liquid refrigerant therein;

a liquid outlet from said receiver extending downwardly from said receiver and interconnected to said bypass means at an elevation below said receiver whereby a static pressure head of liquid refrigerant is present in said bypass means to condense any gaseous refrigerant entering the bypass means and causing flow of refrigerant from said condenser to be routed to the top of said receiver during operation in elevated ambient temperature conditions and to backflood the condenser during cooler ambient temperature conditions to subcool the liquid refrigerant, thereby increasing the efficency and capacity of the refrigeration system.

2. A refrigeration system as defined in claim 1, wherein said pressure regulating means directs a portion of said gaseous refrigerant from said compressor to the top of said receiver whenever the pressure in said receiver drops below a predetermined pressure, said pressure regulating means comprising an adjustable outlet pressure regulating valve, the pressurization of said receiver during cool ambient temperature causing back flooding in said condenser due to the pressure drop normally through said condenser, said back flooding limiting the condensing surface of said condenser thereby elevating the condensing pressure, said condensing pressure transmitted to said receiver thereby assuring an adequate liquid refrigerant flow to said expansion device and evaporator.

3. A refrigeration system as defined in claim 1, wherein said bypass means interconnects the outlet of said receiver and the outlet of said condenser, said condenser and said receiver being positioned at an elevated position with respect to said bypass means, said static pressure being the pressure differential caused by the difference between the elevation of said liquid refrigerant in said receiver and the elevation of said liquid refrigerant in said bypass means, said static pressure of liquid in said bypass means being sufficient to condense any uncondensed said gaseous refrigerant emitted from said condenser at the lower portion of said bypass means and causing the majority of said gaseous and liquid refrigerant emitted from said condenser to flow into the top of said receiver, the liquid in said receiver flowing from the outlet of said receiver to said expansion device in warm weather conditions, said level of liquid in said bypass means and said back flooded condenser during cool ambient conditions being greater than the level of liquid in said receiver and receiver outlet causing the majority of liquid refrigerant emitted from said condenser to flow through said bypass means, and thereby to said expansion device and evaporator.

4. A refrigeration system as defined in claim 1, further comprising a first three-way juncture located between said compressor, said pressure regulating means and said condenser, said first three-way juncture interconnecting a first flow path and a second flow path for said gaseous refrigerant, said first flow path interconnecting said compressor and said condenser, said second flow path interconnecting said compressor and said pressure regulating means.

5. A refrigeration system as defined in claim 4, wherein a second three-way juncture is located between said condenser outlet, said outlet pressure regulating means and said receiver.

6. A refrigeration system as defined in claim 5 wherein a third three-way juncture is located between said condenser outlet, said second juncture and said bypass means, said third three-way juncture providing a fluid flow path interconnecting said condenser outlet and said second juncture, said bypass means interconnecting said condenser and said expansion device.

7. A refrigeration system as defined in claim 5, wherein a fourth three-way juncture is located between the outlet of said receiver, said bypass means and said expansion device, said fourth three-way juncture providing a liquid flow path to said expansion device from either said bypass or said receiver.

8. A refrigeration system as defined in claim 4, further comprising a check valve between said first three-way juncture and said pressure regulating means preventing the flow of said gaseous refrigerant from said receiver to said condenser when said compressor is not operating.

9. A refrigeration system as defined in claim 6, wherein said check valve permitting flow from the condenser to the top of the receiver is positioned between said second three-way juncture and said third three-way juncture preventing the flow of said gaseous refrigerant and said liquid refrigerant from said second juncture to said third juncture.

10. A refrigeration system as defined in claim 7, further comprising a check valve between said third three-way juncture and said fourth three-way juncture preventing the flow of said gaseous refrigerant and said liquid refrigerant from said fourth three-way juncture to said third three-way juncture.

11. A refrigeration system as defined in claim 7, wherein said fourth three-way juncture comprises a small sub-receiver, said sub-receiver being located at an elevation sufficiently below said receiver and said condenser wherein said static pressure condenses any uncondensed said gaseous refrigerant emitted from said condenser in said bypass means to said sub-receiver.

12. A refrigeration sytstem as defined in claim 1, wherein said receiver is located at a elevation approximately the same as the elevation of the said condenser.

13. The system of claim 1 having a plurality of evaporators.

14. The system of claim 1 having a plurality of compressors.

15. A refrigeration system having a closed loop, comprising, a air cooled condenser exposed to outside ambient condition;

a receiver for separating liquid and gaseous refrigerant, said receiver located at a elevation approximately the same as the elevation of the condenser to eliminate static head pressure between the condenser and the receiver;

an expansion device;

at least one compressor connected between the evaporator and the condenser;

a diversion line to direct refrigerant gas from the discharge of the compressor to top of the receiver, the diversion line including a outlet pressure regulating valve;

a line exiting the condenser having a three way junction defining a first flowpath permitting flow to said diversion line downstream from the outlet pressure regulating valve and then into the receiver and a second flowpath emitting flow into a bypass conduit;

check valve means in said first flowpath to provide for flow in the direction of the condenser to the receiver only;

check valve means in said bypass permitting flow around the receiver and connecting to a liquid line connected at a liquid line connection to said expansion device, said liquid line connection located at a substantial elevation below the receiver;

a liquid flowpath connecting the bottom of the receiver to said liquid line and forming with said second flowpath a drop leg to exert a static head;

the static head at said liquid line preventing the mass and velocity of any uncondensed gas from entering the liquid line from the bypass line and causing liquid and uncondensed gas to flow from the condenser through the first flowpath to the receiver.

16. The apparatus of claim 15 and futher including a three connection sub-receiver interconnecting said liquid flowpath, said bypass and said liquid line.

17. The system of claim 15 further including a two connection sub-receiver interconnecting said liquid line and said bypass, said liquid flowpath joins said liquid line exiting the bottom of the sub-receiver at close proximity to the sub-receiver.

18. The system of claim 15 wherein the said second flowpath from the outlet of the condenser and said liquid flowpath from the bottom of the receiver forms a three way junction with said liquid line connecting to the expansion device and wherein the junction is at a elevation lower than the receiver to form a sufficient drop leg and said bypass line also connects also connects with the three way junction so that uncondensed gas from the bypass line will not enter the three way junction.

19. A refrigeration system having a closed refrigeration loop, comprising:

an air cooled condenser exposed to outside ambient conditions and located at an elevation substantially above the other operational equipment of the system;

a receiver for separating liquid and gaseous refrigerant, said receiver located at an elevation substantially below the elevation of the condenser;

an expansion device;

at least one evaporator;

at least one compressor connected between the evaporator and the condenser;

an inlet pressure regulating valve in the outlet line of the condenser at close proximity to said receiver, said valve closing on a drop in the inlet pressure to backflood liquid in the condenser to maintain a minimum set condensing pressure;

a line from the outlet of the inlet pressure regulating valve having a three-way junction defining a first flowpath to the receiver and a second flowpath forming a bypass line around the receiver;

check valve means in the first flowpath to provide for flow in the direction from the condenser to the receiver only;

a diversion line to direct gas from the discharge of the compressor to the top of the receiver, the diversion line including an outlet pressure regulating valve that opens on a drop in outlet pressure to maintain a pressure in the receiver slightly below the pressure in the condenser as controlled by said inlet pressure regulating valve;

a line from the outlet of the outlet pressure regulating valve that interconnects with said first flowpath downstream from said check valve;

a check valve in said diversion line to prevent migration of refrigerant from the receiver to the condenser;

a liquid flowpath extending downwardly from the bottom of the receiver forming a drop leg and interconnecting with said bypass line at a small sub-receiver located at a substantial elevation below the receiver, the static head in said drop leg, sub-receiver and bypass line preventing uncondensed gas from entering said sub-receiver; and a liquid line connecting the bottom of the sub-receiver to the expanision device.

20. A refrigeration system as defined in claim 19 wherein the said sub-receiver is located at about the same elevation as the said receiver, said sub-receiver having a side arm connection sensitive to the liquid level in said sub-receiver;

a liquid level sensing thermistor 51 located in said side arm which through a solid state control circuit 50 activates to close a solenoid valve 52 in said bypass line when uncondensed gas from said bypass line enters sub-receiver and causes liquid level in said sub-receiver to fall below the level where the thermistor is located.

21. The system of claim 19 wherein the liquid level sensing device is a float switch.

* * * * *